US005825297A

United States Patent [19]

Mooney et al.

[11] Patent Number: 5,825,297

[45] Date of Patent: Oct. 20, 1998

[54] TAUT ARMATURE RECIPROCATING IMPULSE TRANSDUCER

[75] Inventors: Charles W. Mooney, Lake Worth; John M. McKee, Hillsboro Beach; Irving Harold Holden, deceased, late of Boca Raton, by Virginia Holden, legal representative; Gerald Eugene Brinkley, Wellington, all of Fla.

[73] Assignee: Motorola, Inc., Schaumburg, Ill.

[21] Appl. No.: 684,957

[22] Filed: Jul. 19, 1996

[51] Int. Cl.[6] ..... B06B 1/04

[52] U.S. Cl. ..... 340/825.46; 340/407.1; 340/691; 116/204

[58] Field of Search ..... 340/825.44, 825.46, 340/407.1, 311.1, 691, 825.47, 825.69; 455/38.2, 426; 370/313, 310, 312; 116/204, DIG. 44

[56] References Cited

U.S. PATENT DOCUMENTS

| | | | |
|---|---|---|---|
| 5,023,504 | 6/1991 | Mooney et al. | 340/825.46 X |
| 5,107,540 | 4/1992 | Mooney et al. . | |
| 5,172,092 | 12/1992 | Nguyen et al. | 340/825.46 X |
| 5,327,120 | 7/1994 | McKee et al. | 340/825.46 |
| 5,524,061 | 6/1996 | Mooney et al. | 381/200 X |
| 5,546,069 | 8/1996 | Holden et al. | 340/407.1 |
| 5,649,020 | 7/1997 | McClurg et al. | 340/825.46 X |
| 5,650,763 | 7/1997 | McKee et al. | 340/825.46 X |

OTHER PUBLICATIONS

Motorola Advisor Message Receiver documentation (c) 1990—no month.

*Primary Examiner*—Brian Zimmerman
*Assistant Examiner*—William H. Wilson, Jr.
*Attorney, Agent, or Firm*—Philip P. Macnak

[57] ABSTRACT

A taut armature reciprocating impulse transducer (100) includes an electromagnetic driver (24, 26) which effects an alternating electromagnetic field in response to an input signal. An armature (12) includes an upper planar suspension member (14) formed by a first pair of non-linear spring members arranged along a first radial axis (50), and a lower planar suspension member (16) formed by a second pair of non-linear spring members arranged along a second radial axis (52) which is substantially perpendicular to the first radial axis (50). The upper and lower planar suspensions members are coupled to the electromagnetic driver (24, 26) and suspend a magnetic motional mass (18) therebetween. The alternating electromagnetic field alternately moves the magnetic motional mass (18), the movement being transformed through the upper and lower planar suspension members (14, 16) and the electromagnetic driver (24, 26) into motional energy.

14 Claims, 4 Drawing Sheets

SECTION A–A 123

14, 16

500

TAUT ARMATURE RECIPROCATING IMPULSE TRANSDUCER

BACKGROUND OF THE INVENTION

1. Field of the Invention

This invention relates in general to electromagnetic transducers, and more specifically to an taut armature reciprocating impulse transducer.

2. Description of the Prior Art

Portable communication devices, such as pagers, have generally used cylindrical motors which spin an eccentric counterweight or "pancake" motors which utilize eccentric armature weighting to generate a tactile, or vibratory" alert. Such an alert is desirable to generate a "silent" alert which is used to alert the user that a message has been received without disrupting persons located nearby. While such devices have worked satisfactorily for many years and are still widely being used, several issues limit a much broader use. Motors, when used to provide a tactile, "silent", alert are rarely "silent", but rather provide a perceptible acoustic output due in part to the high rotational frequency required for the operation of the motor to spin the counterweight sufficiently to provide a perceptible tactile stimulation. Likewise, such motors, as a result of their inherent design, have generally consumed a substantial amount of energy for operation. This has meant that the motor must be switched directly from the battery for operation, and significantly impacts the battery life that can be expected during normal operation of the portable communication devices.

Recently, a new generation of non-rotational, radial electromagnetic transducers was described by Mooney et al., U.S. Pat. No. 5,107,540, and McKee et al., U.S. Pat. No. 5,327,120, which significantly reduced the energy consumed from a battery for operation as a tactile alerting device. In addition, since the electromagnetic transducer operated at a sub-audible frequency which maximized the tactile sensation developed when the transducer is coupled to a person, a truly silent non-disruptive alert was provided. Because the size and shape of the radial electromagnetic transducer was similar to that of a pancake motor, retrofits of the new device could readily be more accommodated in established communication devices with little change to the driving circuitry or mechanics.

While the new generation of non-rotational, radial electromagnetic transducers have significantly reduced the energy consumption, and have also significantly reduced the sound developed when in actual operation, there is yet a need for an electromagnetic transducer which provides even lower energy consumption, provides an even lower profile and can be readily adapted for use in thin electronic devices, such as a credit card communication device, while maintaining the performance characteristics of the radial electromagnetic transducers.

SUMMARY OF THE INVENTION

In accordance with the present invention, a taut armature reciprocating impulse transducer includes an electromagnetic driver which effects an alternating electromagnetic field in response to an input signal; an armature, including an upper planar suspension member formed by a first pair of non-linear spring members arranged along a first radial axis and a lower planar suspension member formed by a second pair of non-linear spring members arranged along a second radial axis, wherein the upper and lower planar suspension members are coupled to the electromagnetic driver, wherein the first radial axis of the upper planar suspension member is oriented substantially perpendicular to the second radial axis of the lower planar suspension member; and a magnetic motional mass which is suspended between the upper and lower planar suspension members, and which is coupled to the alternating electromagnetic field for alternately moving the magnetic motional mass in response thereto. Movement of the magnetic motional mass is transformed through the upper and lower planar suspension members and the electromagnetic driver into motional energy.

DESCRIPTION OF THE PREFERRED EMBODIMENTS

Figure 1:
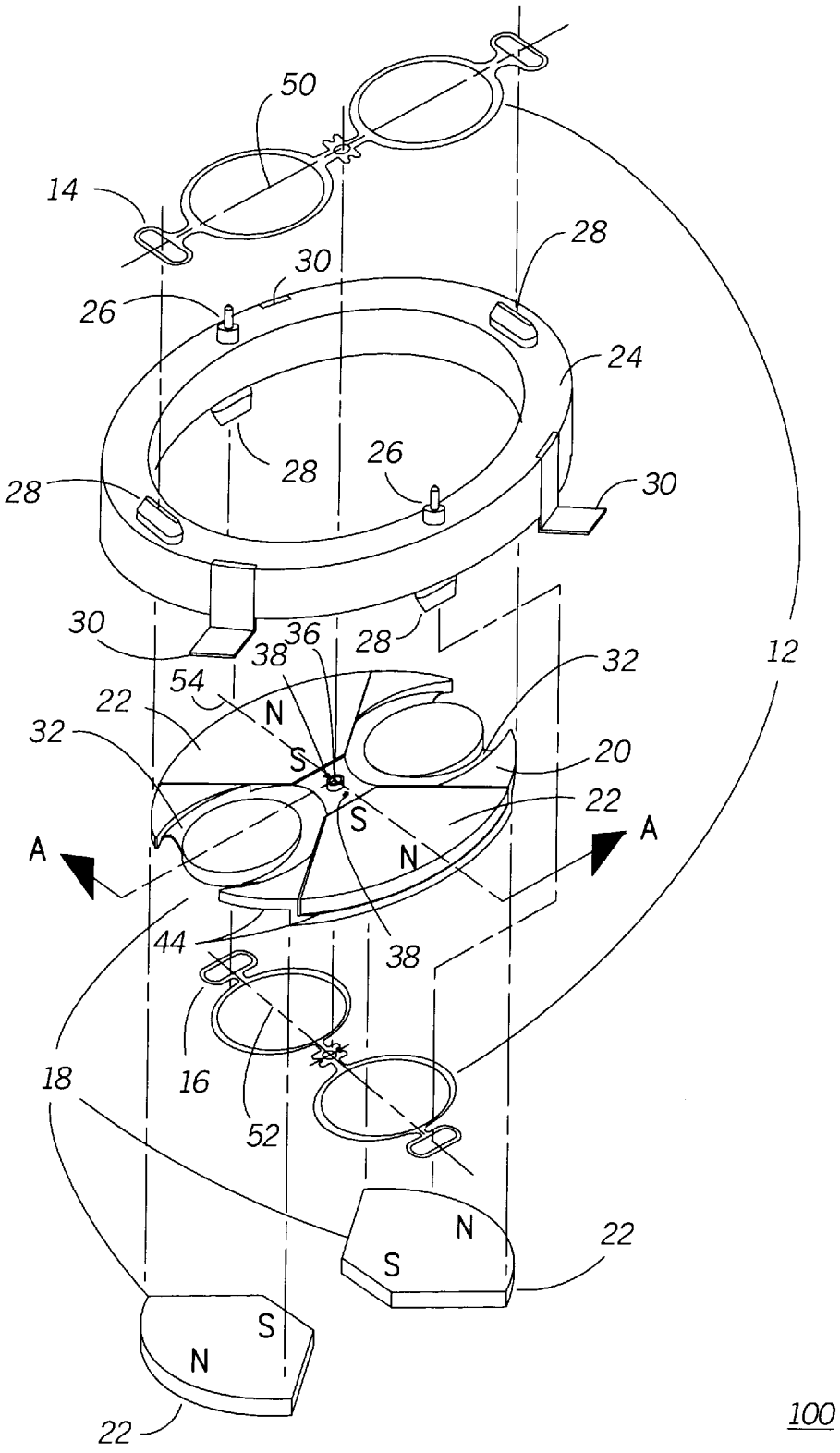
FIG. 1 is an exploded view of a taut armature reciprocating transducer in accordance with the present invention.
Figure 2:
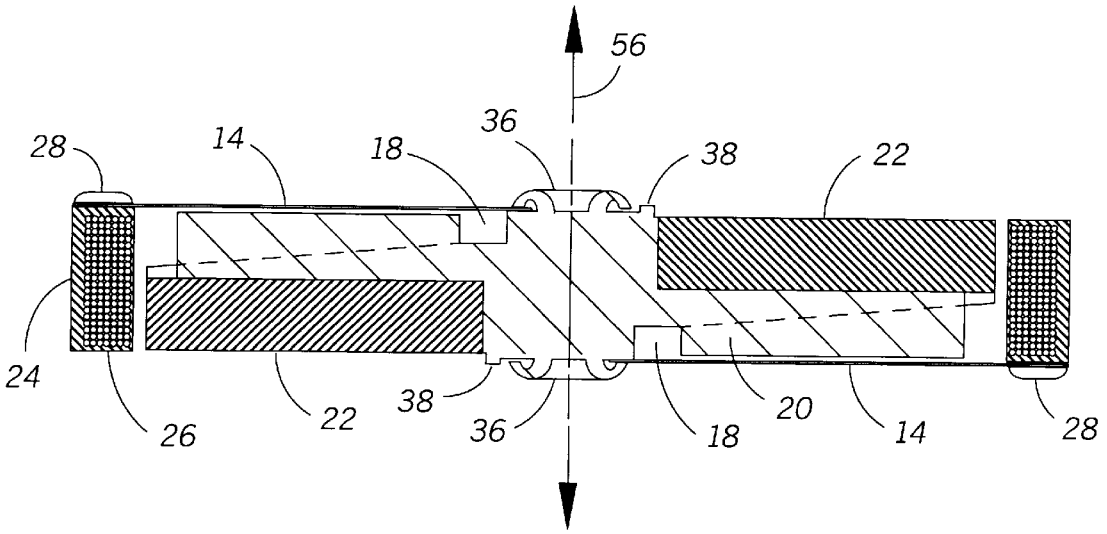
FIG. 2 is a cross-sectional view of the taut armature reciprocating transducer in accordance with the present invention.

FIG. 1 shows an exploded view, and FIG. 2 shows a cross-sectional view, of a taut armature reciprocating transducer 100 in accordance with the present invention. The taut armature reciprocating impulse transducer 100 comprises an armature 12 including an upper suspension member 14 and a lower suspension member 16, a support frame 24 which includes a coil 26, and a magnetic motional mass 18. The magnetic motional mass 18 includes a magnet support 20 which is used to retain a plurality of permanent magnets 22, four of which are shown, of which two are shown seperate from the magnet support 20. The support frame 24 and the coil 26, in combination, are referred to as an electromagnetic driver (24, 26).

The electromagnetic driver (24, 26) is used to effect an alternating electromagnetic field in response to a being supplied a driving voltage as will be described further below. By way of example, the coil 26 comprises approximately two hundred and twenty-seven (227) turns of No. 44 gauge enamel coated copper wire which terminates in coil termination 26, and which presents a one hundred (100) ohm resistance. The electromagnetic driver (24, 26) is preferably manufactured using an injection molding process wherein the coil 26 is molded into the support frame 24. It will be appreciated that other manufacturing techniques for forming the electromagnetic driver (24,26), can be utilized as well. By way of example, a 30% glass-filled liquid crystal polymer is used to form the support frame 24, although it will be appreciated that other injection moldable thermoplastic materials can be utilized as well. The upper planar suspension member 14 and the lower planar suspension member 16 are attached to the support frame 24 by four bosses 28 as will be described below, thereby positioning the upper planar suspension member 14 to be substantially parallel to the lower planar suspension member 16. Mounting leads 30, three of which are shown by way of example, are preferably attached to the support frame 24 during the injection molding process. It will be appreciated that in one embodiment of the present invention, the mounting leads 30 are used to provide only a mechanical connection to a supporting substrate, such as a printed circuit board, and in another embodiment, the mounting leads 30 can provide both electrical contact and mechanical connection to the supporting substrate when the mounting leads 30 are identified in a manner to designate which of the three leads provide the electrical input to the coil 26.

The magnetic motional mass 18 includes the magnet support 20 and four permanent magnets 22. The magnet support 20 is preferably manufactured using a die casting process and is preferably cast from a die casting material such as Zamak 3 zinc die-cast alloy. It will be appreciated that the magnetic motional mass 18 can also be manufactured using other casting processes, such as an investment casting process, using casting materials such as tungsten which increase significantly the mass to volume ratio of the magnet support 20 such as would be required to achieve significantly lower frequency operation. The magnet support 20 includes two upper cavities 42 arranged about a common radial axis 54 and positioned within opposite quadrants in the upper surface of the magnet support 20, and further includes two lower cavities 44 arranged about a common radial axis (not shown) and positioned within opposite quadrants in the lower surface of the magnet support 20. As shown in FIG. 1, the common radial axis 54 of the two upper cavities 42 are arranged perpendicular to the common radial axis of the lower cavities 44 within the magnet support 20. The magnet support 20 further includes upper channels 32 formed in the upper surface opposite the two lower cavities 44, and lower channels (not shown) formed in the lower surface of the magnet support 20 opposite the two upper cavities 42. The two upper channels 32 and the two lower channels enable portions of the magnet support 20 to pass freely through apertures within the upper planar suspension member 14 and the lower planar suspension member 16 during movement of the magnetic motional mass 18, thereby maximizing a displacement along axis 56 (FIG. 2) which can be achieved when the magnetic motional mass 18 is driven by the electromagnetic driver (24, 26). The axis 56 (FIG. 2) is normal to the plane of the upper and lower planar suspension members. Also, it will be appreciated that the channels are more easily molded with reasonable tolerances in the magnet support as compared to molding channels within the permanent magnets which can significantly change dimension during the sintering process.

Each of the permanent magnets 22 generates a magnetic field and are retained within the magnet support 20 in a predetermined N-S magnetic field orientation, which by way of example in FIG. 1 places the south magnetic poles toward the center of the magnet support 20, and the north magnetic poles toward the perimeter of the magnet support 20, thereby placing the south magnetic poles of the permanent magnets 22 in opposition. The permanent magnets 22 are preferably formed from a Samarium Cobalt material having a 25 MGOe minimum magnetic flux density, although it will be appreciated that other high flux density magnetic materials can be utilized as well, the paermanent magnet of choice having the highest flux density and mass. The permanent magnets are retained within the upper and lower cavities of the magnet support 20 using, by way of example, an adhesive bonding material, such as a thermoset beta-stage epoxy preform which is cured using heat and pressure, and because the magnetic poles of the permanent magnets 22 are in opposition, the permanent magnets 22 must be fixtured during the curing process. When properly retained within the upper and lower cavities, the predetermined N-S magnetic field orientation of each of the permanent magnets 22 is oriented parallel to the radial axis of the upper cavities 42 and the lower cavities 44.

The magnet support 20 includes a planar central region located at the center of the upper and lower surfaces of the magnet support 20, and includes mounting flanges 36 (one of which is shown) which is utilized to fasten the magnetic motional mass 18 to the upper planar suspension member 14 and the lower planar suspension member 16 using, by way of example, an orbital riveting or other suitable process. Two bosses 38 are used to orient the upper planar suspension member 14 and the lower planar suspension member 16 such that the radial axis 50 of the upper planar suspension member 14 is oriented substantially perpendicular to the common radial axis 54 of the two upper cavities 42, and the radial axis 52 of the lower planar suspension member 16 is oriented substantially perpendicular to the common radial axis of the two lower cavities 44. In addition to orienting the upper and lower planar suspension members, the two bosses 38 on the upper and lower surfaces of the magnet support provide a means for preventing a rotation of the magnetic motional mass 18 relative to the upper and lower planar suspension members.

The taut armature reciprocating transducer 100 described above provides improved performance as compared to prior non-rotational, radial electromagnetic transducers. The performance improvement is obtained by the use of a magnetic motional mass 18 which maximizes the size and energy product of the permanent magnets 22, providing a magnetic/electromagnetic interface of substantially 360 degrees between the magnetic motional mass 18 and the electromagnetic driver (24, 26). The performance is further enhanced through the use of the planar suspension members 14, 16 which are mounted perpendicular to each other and in opposite quadrants to the quadrants in which the permanent magnets are affixed to the magnet support 20, as described above. The magnet support 20 also includes channels which maximize the amplitude of motion of the magnetic motional mass without increasing the overall thickness of the magnetic motional mass, as would be required when a ring magnet is utilized in the place of the four permanent magnets in accordance with the present invention. As a result of maximizing the energy product of the magnetic structure, it will also be appreciated that the electromagnetic driver (24, 26) current can be reduced while maintaining the tactile energy output of the taut armature reciprocating transducer 100.

Figure 3:
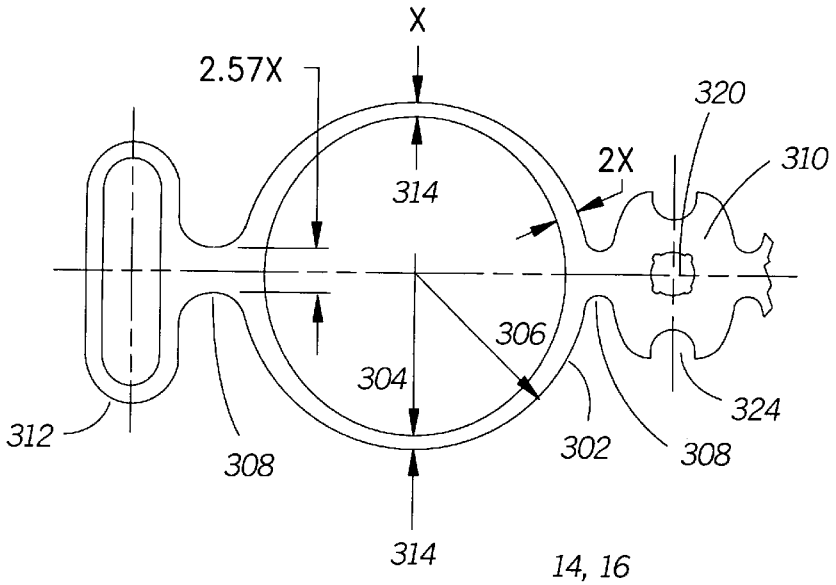
FIG. 3 is a top elevational view of a planar suspension member utilized in the taut armature reciprocating impulse transducer of FIG. 1 in accordance with a first embodiment of the present invention.

FIG. 3 is a top view of a planar suspension member (14 or 16) which can be utilized in the taut armature reciprocating transducer 100 in accordance with a first embodiment of the present invention. The planar suspension member comprises a pair of non-linear spring members 302 which are defined by a circular outer diameter 306 and an elliptical inner diameter 304, thereby providing a spring member having a non-uniform width, the width "2X" being the widest in the region contiguous to the end restraints 308, and tapering to a width "X" about the midpoints 314 of the axial non-linear spring members 302. The non-linear spring members 302 couple through end restraints 308 of substantially uniform width "2.57X" symmetrically about a contiguous planar central region 310 and also connect to a pair of contiguous planar end restraints 312 (one of which is shown). The contiguous planar central region 310 includes a centrally located hole 320 for mounting the upper and lower planar suspension members to the magnetic motional mass 18, and features 324 for preventing rotation of the magnetic motional mass 18 relative to the upper and lower planar suspension members. Additional information on the planar suspension member of FIG. 3 is disclosed in U.S. patent application Ser. No. 08/297,730 filed Aug. 29, 1994, entitled "Dual Mode Transducer for a Portable Receiver" which is assigned to the Assignee of the present invention.

Figure 4:
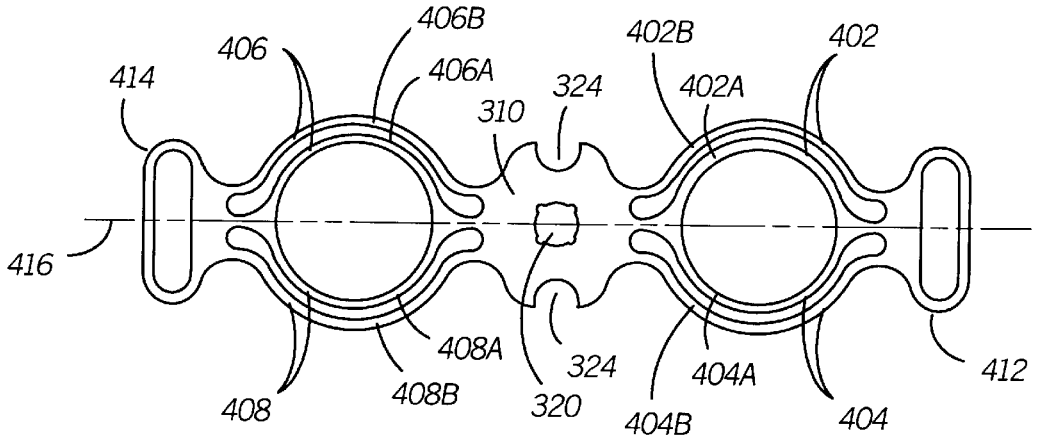
FIG. 4 is a top elevational view of a planar suspension member utilized in the taut armature reciprocating impulse transducer of FIG. 1 in accordance with a second embodiment of the present invention.

FIG. 4 is a top elevational view of a planar suspension member (14 or 16) which can be utilized in the taut armature reciprocating impulse transducer 100 in accordance with an alternate embodiment of the present invention and is utilized for providing operation at higher frequencies as compared to the planar suspension member of FIG. 3. The planar suspension members 14, 16 comprises a pair of juxtaposed planar compound beams 402, 404 and 406, 408 which are connected symmetrically about a contiguous planar central region 310 which includes a centrally located hole 320 for mounting the upper and lower planar suspension members to the magnetic motional mass 18, and features 324 for preventing rotation of the magnetic motional mass 18 relative to the upper and lower planar suspension members. The juxtaposed planar compound beams 402, 404 and 406, 408 are also connected respectively to a corresponding one of a pair of contiguous planar end restraints 412, 414. Each of the juxtaposed planar compound beams 402 and 404, and 406 and 408 comprise respectively two independent concentric arcuate beams, inner beams 402A, 404A, 406A and 408A, and outer beams 402B, 404B, 406B and 408B, each having substantially identical spring rates (K). The substantially identical spring rates are achieved by reducing the width of the inner beam relative to the width of the outer beam over a functional beam length 1. Additional information on the planar suspension member of FIG. 4 is disclosed in U.S. patent application Ser. No. 08/341,242 filed Nov. 17, 1994, entitled Taut Armature Resonant Impulse Transducer" which is assigned to the Assignee of the present invention.

The planar suspension members 14, 16 as shown in FIGS. 3 and 4 are preferably formed from a sheet metal, such as 0.0040 inch (0.10 mm) thick Sandvik™ 7C27Mo2 Stainless Steel produced by Sandvik Steel Company, Sandviken, Sweden, which is preferably formed using a chemical milling or etching process, although it will be appreciated that other part forming processes can be utilized as well.

The design of the taut armature reciprocating impulse transducer 100 provides for Z-axis assembly techniques such as utilized in an automated robotic assembly process, or line. The assembly process will be briefly described below. After the permanent magnets 22 have been assembled to the magnet support 20 as described above, the upper planar suspension member 14 is positioned onto the flanges 36 on the top surface of the magnet support 20, and is then staked, such as by using an orbital riveting process. The magnetic motional mass 18 is next placed into the cavity shown in FIG. 1. within the support frame 24, and is positioned relative to the support frame 24 at the planar end restraints of the upper planar suspension member 14. The upper planar suspension member 14 is then secured to the support frame 24 by deforming the bosses 28 using a staking process, such as heat or ultrasonic staking. The support frame 28 is then turned over, and the lower planar suspension member 16 is positioned over the flange 36 and the bosses 28. The bosses 28 are then deformed as described above, after which the flange is staked, also as described above, thus completing the assembly of the magnetic motional mass 18 to the support frame 24 and the armature 12.

Figure 5:
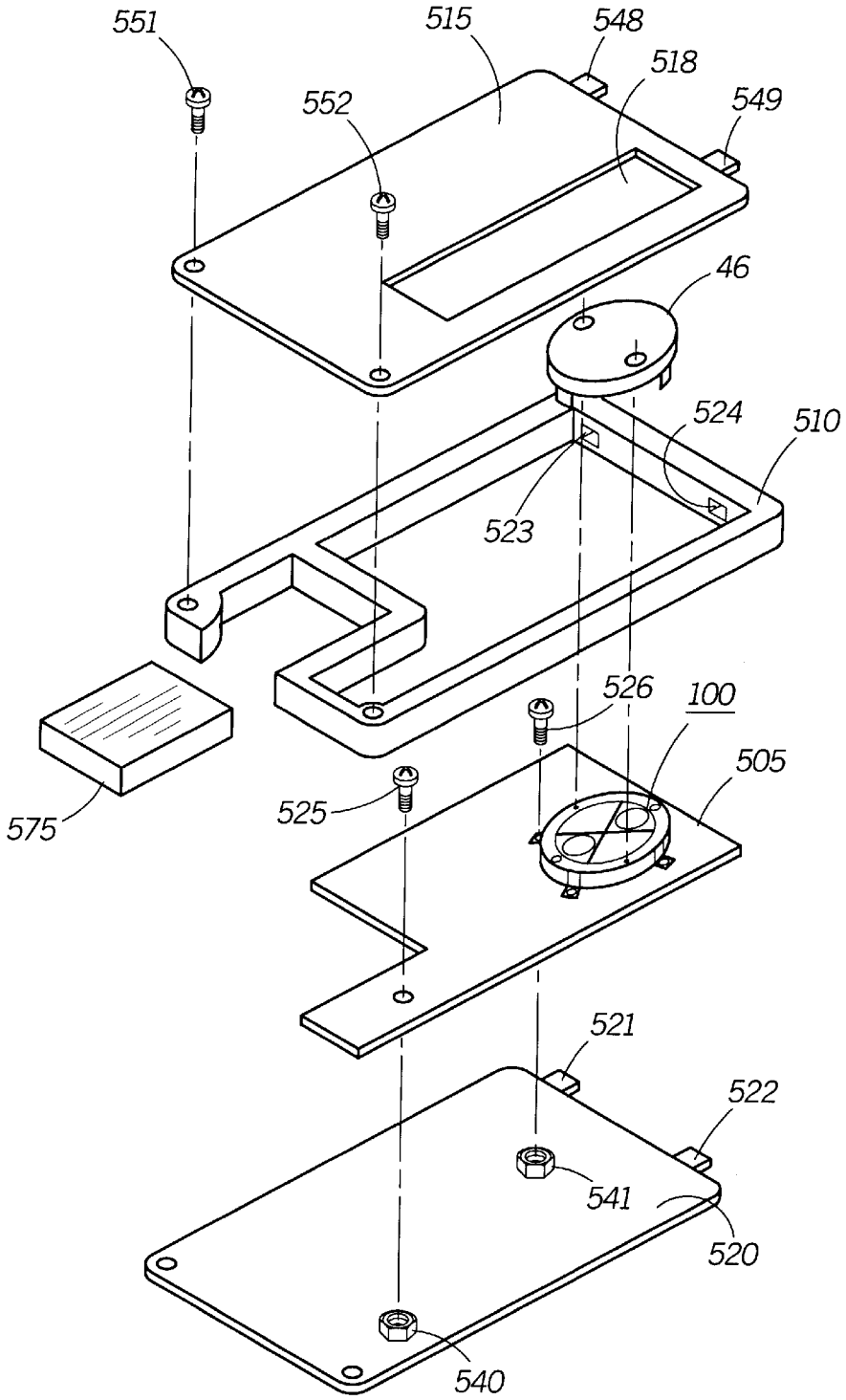
FIG. 5 is an exploded view of a communication device utilizing the taut armature reciprocating impulse transducer in accordance with the present invention.

The taut armature reciprocating impulse transducer 100 which has been assembled as described above, can be utilized as is, i.e. without a housing, or can be provided with a housing to enclose the taut armature reciprocating impulse transducer 100. The housing, preferably comprises at least an upper housing section 46 as shown in FIG. 5 to be described below. The upper housing section 46 is preferably formed using "316" stainless steel using a suitable forming process such as a sheet metal drawing and forming process. It will be appreciated that other non-magnetic materials can be utilized as well to form the upper housing section 46.

FIG. 5 is an exploded view of an electronic device 500 utilizing the taut armature reciprocating impulse transducer 100 in accordance with the present invention. The taut armature reciprocating impulse transducer 100 is especially suited for use in an electronic device 500 which has a thin profile, such as in a credit card pager. It will be appreciated that the taut armature reciprocating impulse transducer 100, because of its low profile and low power requirement as described above, can be utilized in any thin profile electronic device which has provision for a tactile alert. As shown in FIG. 5, the electronic device 500 includes by way of example a frame 510 and an upper cover 515 and a lower cover 520 which enclose a supporting substrate 505, such as a printed circuit board to which the taut armature reciprocating impulse transducer 100 is affixed, such as by soldering or other suitable method. In the example shown, the upper cover 515 and the lower cover 520 have by way of example tabs 548, 549 and 521, 522, respectively, which engage recesses 523 and 524 in the frame 510, and which are secure to the frame 510 by screws 551, 552. The supporting substrate 505 is secured, by way of example, to the bottom cover 520 using screws 525, 526 which engage nuts 540, 541 which have been secured to the lower cover 520 by any of a number of well known securing techniques. Power to the electronic device 500 is provided by a battery 575, which is typically a button cell battery.

The taut armature reciprocating impulse transducer 100 in accordance with the present invention is optimally driven utilizing a swept frequency input signal, such as described in U.S. patent application Ser. No. 08/297,730 and U.S. patent application Ser. No. 08/341,242. A sub-audible input signal having a swept frequency range above the fundamental mode frequency of the taut armature reciprocating impulse transducer 100, when coupled to the electromagnetic driver 24, 26 generates tactile energy created by the displacement of the magnetic motional mass in a direction normal to the plane of the upper and lower suspension members. The displacement amplitude of the magnetic motional mass increases non-linearly over a predetermined frequency range above the fundamental mode frequency resulting in an increasing tactile energy output.

Figure 6:
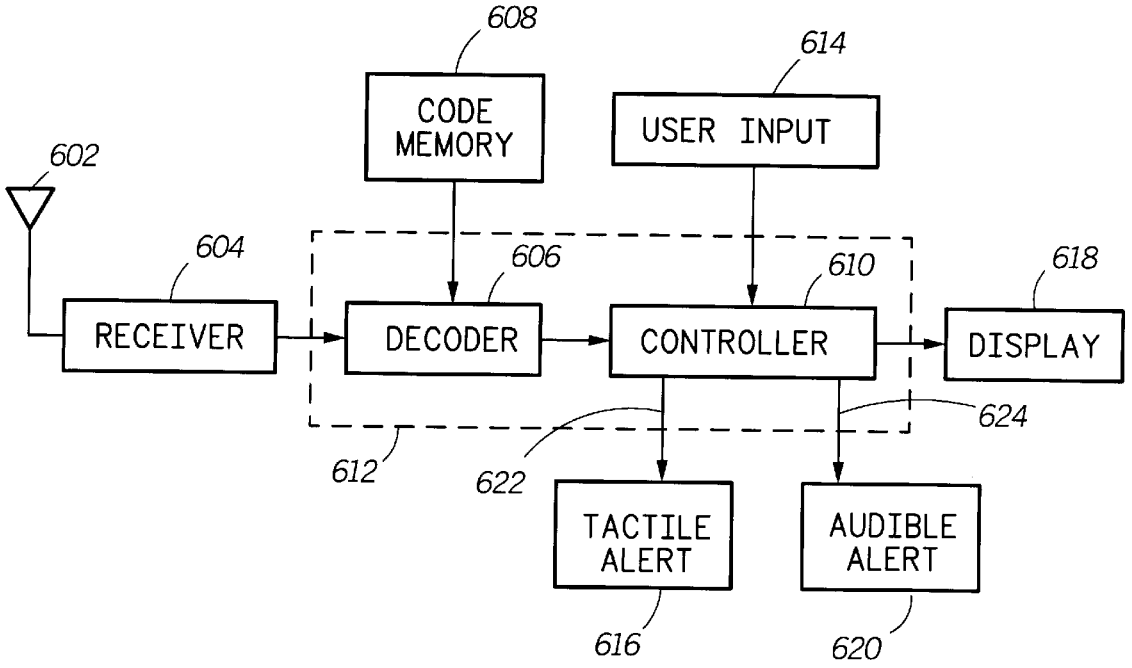
FIG. 6 is an electrical block diagram of a communication device utilizing the taut armature reciprocating impulse transducer in accordance with the present invention.

FIG. 6 is an electrical block diagram of a electronic device 600 utilizing the taut armature reciprocating impulse transducer 100 in accordance with the present invention. By way of example, the electronic device 600 is a communication device, such as paging receiver suitable for inclusion into the housing described in FIG. 5 above. The paging receiver includes an antenna 602 which intercepts coded message signals including message information transmitted in any of a number of well known signaling protocols, such as the POCSAG (Post Office Code Standardization Advisory Group) signaling protocol or the FLEX™ signaling protocol. The message information intercepted by the antenna 602 is coupled to the input of a receiver 604 which receives and demodulates the received coded message signals in a manner well known in the art, and provides at the output a stream of message information representative of the message transmitted. The stream of message information, which typically includes demodulated address and message information which is coupled to a decoder 606 which processes the address information. When the address information matches predetermined waddress information stored in a code memory 608, the decoder 606 generates an output signal enabling the processing of the message information following the address. A controller 610 processes the message information in a manner well known in the art, storing the message information in a memory (not shown) and generates an alert control signal 622 which is coupled to a tactile alerting device, 616, such as the taut armature reciprocating impulse transducer 100 described above, or an alert control signal 624 which is coupled to an audible alerting device 620, alerting the user of the receipt of the message. It will be appreciated that the functions of the decoder 606 and the controller 610 can be performed by a single electronic device, such as a microcomputer 612 in a manner well known to one of ordinary skill in the art. The stored message information can be recalled by the user through a user input 614 which typically includes one or more switches. When a message is recalled from memory, the message is presented on a display 618, such as a liquid crystal display.

In summary, a taut armature reciprocating impulse transducer 100 has been described above which maximizes the tactile energy output as compared to prior non-rotational, radial electromagnetic transducers. The tactile energy output is maximized by maximizing the size of the permanent magnets utilized in the magnetic motional mass 18. The tactile energy output is further maximized by optimizing the configuration of the permanent magnets within the magnetic motional mass 18. The permanent magnet configuration enables the utilization of a unique armature configuration, wherein the radial axis of the upper and lower planar suspension members 14, 16 are oriented normal to each other, and normal to the permanent magnets on the surface of the magnetic motional mass corresponding thereto. The orientation of the permanent magnets relative to the planar suspension members allows the use of channels formed within the magnet support which maximize the displacement 56 (FIG. 2) of the magnetic motional mass 18 during operation. By maximizing the size of the permanent magnets, the total energy product is maximized which further results in a reduction in the current drain necessary to achieve an equivalent tactile energy output to the prior non-rotational, radial electromagnetic transducers.

While specific embodiments of this invention have been shown and described, further modifications and improvements will occur to those skilled in the art. All modifications which retain the basic underlying principles disclosed and claimed herein are with the scope and spirit of the present invention.

We claim:

1. A taut armature reciprocating impulse transducer, comprising:

an electromagnetic driver, for effecting an alternating electromagnetic field in response to an input signal;

an armature, including an upper planar suspension member formed by a first pair of non-linear spring members arranged along a first radial axis and a lower planar suspension member formed by a second pair of non-linear spring members arranged along a second radial axis, wherein said upper and lower planar suspension members are coupled to said electromagnetic driver, and said first radial axis of said upper planar suspension member is oriented substantially perpendicular to said second radial axis of said lower planar suspension member; and a magnetic motional mass suspended between said upper and lower planar suspension members, and coupled to said alternating electromagnetic field for alternately moving said magnetic motional mass in response thereto, a displacement of said magnetic motional mass being transformed through said upper and lower planar suspension members and said electromagnetic driver into motional energy.

2. The taut armature reciprocating impulse transducer according to claim 1, wherein said first pair of non-linear spring members and said second pair of non-linear spring members are connected symmetrically about a contiguous planar central region, and further connected to a pair of contiguous planar end restraints.

3. The taut armature reciprocating impulse transducer according to claim 2, wherein said non-linear spring members are defined by circular outer perimeters and elliptical inner perimeters.

4. The taut armature reciprocating impulse transducer according to claim 2, wherein said non-linear spring members comprising a pair of juxtaposed planar compound beams.

5. The taut armature reciprocating impulse transducer according to claim 4, wherein said pair of juxtaposed planar compound beams each comprise at least two independent concentric arcuate beams.

6. The taut armature, reciprocating impulse transducer according to claim 5, wherein said at least two independent concentric arcuate beams exhibits a substantially identical spring rate (K).

7. The taut armature reciprocating impulse transducer according to claim 1, wherein said magnetic motional mass comprises:

a magnet support having upper cavities arranged about a third radial axis and formed substantially within opposite quadrants in an upper surface thereof, and further having lower cavities arranged about a fourth radial axis and formed substantially within opposite quadrants in a lower surface thereof, said third radial axis of said upper cavities being arranged substantially perpendicular to said fourth radial axis of said lower cavities; and a plurality of permanent magnets retained within said upper and lower cavities to provide a magnet to electromagnetic driver interface of substantially 360°.

8. The taut armature reciprocating impulse transducer according to claim 7, wherein said first radial axis of said upper planar suspension member is oriented substantially perpendicular to said third radial axis of said upper cavities, and wherein said second radial axis of said lower planar suspension member is oriented substantially perpendicular to said fourth radial axis of said lower cavities.

9. The taut armature reciprocating impulse transducer according to claim 7, wherein said magnet support further includes upper channels formed on said upper surface opposite said lower cavities, and lower channels formed on said lower surface opposite said upper cavities, said upper and lower channels enabling portions of said magnet support to pass freely through apertures within said upper and lower planar suspension members during movement of said magnetic motional mass.

10. The taut armature reciprocating impulse transducer according to claim 7, wherein each of said plurality of permanent magnets generates a magnetic field having a predetermined N-S magnetic field orientation, and wherein said magnet support retains said plurality of permanent magnets such that said predetermined N-S magnetic field orientation of each of said plurality of permanent magnets are in opposition.

11. The taut armature reciprocating impulse transducer according to claim 10, wherein said predetermined N-S magnetic field orientation of each of said plurality of permanent magnets position in said upper cavities is oriented parallel to said third radial axis of said upper cavities, and said predetermined N-S magnetic field orientation of each of said plurality of permanent magnets position in said lower cavities is oriented parallel to said to said fourth radial axis of said lower cavities.

12. The taut armature reciprocating impulse transducer according to claim 7, wherein said magnet support further comprises features for preventing rotation of said magnetic motional mass relative to said upper and lower planar suspension members.

13. The taut armature reciprocating impulse transducer according to claim 1 further comprising a housing for enclosing said electromagnetic driver, armature, and said magnetic motional mass.

14. A communication device, comprising:

a housing enclosing a supporting substrate;

a receiver, coupled to said supporting substrate, for receiving and demodulating coded message signals including at least an address signal, and for deriving therefrom a demodulated address signal;

a decoder, coupled to said supporting substrate and to said receiver, for decoding the demodulated address signal, and for generating an alert control signal in response to the demodulated address signal matching a predetermined address; and a taut armature reciprocating inertial transducer, responsive to the alert control signal being generated for generating a tactile alert, said taut armature reciprocating inertial transducer comprising an electromagnetic driver, coupled to said supporting substrate and responsive to the alert control signal for effecting an alternating electromagnetic field, an armature, including an upper planar suspension member formed by a first pair of non-linear spring members arranged along a first radial axis and a lower planar suspension member formed by a second pair of non-linear spring members arranged along a second radial axis, wherein said upper and lower planar suspension members are coupled to said electromagnetic driver, and said first radial axis of said upper planar suspension member is oriented substantially perpendicular to said second radial axis of said lower planar suspension member; and a magnetic motional mass suspended between said upper and lower planar suspension members, and coupled to said alternating electromagnetic field for alternately moving said magnetic motional mass in response thereto, a displacement of said magnetic motional mass being transformed through said upper and lower planar suspension members and said electromagnetic driver into motional energy, whereby the motional energy generated is coupled to said housing through said supporting substrate to provide a tactile alert alerting a reception of the coded message signals.

* * * * *